United States Patent [19]

Beacom

[11] Patent Number: 4,782,614

[45] Date of Patent: Nov. 8, 1988

[54] DISPLAY UNIT

[75] Inventor: Martin Beacom, Walton-on-Thames, England

[73] Assignee: Living Images Limited, Hampton, England

[21] Appl. No.: 26,575

[22] PCT Filed: Jul. 11, 1986

[86] PCT No.: PCT/GB86/00398

§ 371 Date: Mar. 11, 1987

§ 102(e) Date: Mar. 11, 1987

[87] PCT Pub. No.: WO87/00328

PCT Pub. Date: Jan. 15, 1987

[30] Foreign Application Priority Data

Jul. 11, 1985 [GB] United Kingdom ..... 8517663

[51] Int. Cl.[4] ..... G09F 13/12; G09F 19/12

[52] U.S. Cl. ..... 40/427; 272/8 M; 353/10

[58] Field of Search ..... 40/582, 436, 427, 219; 272/8 M, 8 D, 8.5; 353/10; 350/144

[56] References Cited

U.S. PATENT DOCUMENTS 720,820 2/1903 Kraus ..... 40/427
1,680,855 8/1928 Burns ..... 272/8 M
1,728,610 9/1929 Horton ..... 272/8 M
2,132,474 10/1938 En Holm ..... 40/219
4,509,837 4/1985 Kassies ..... 353/10

FOREIGN PATENT DOCUMENTS 554835 2/1957 Belgium ..... 40/427

*Primary Examiner*—Gene Mancene
*Assistant Examiner*—Cary E. Stone
*Attorney, Agent, or Firm*—Henry Sternberg; Bert J. Lewen

[57] ABSTRACT

A display unit comprising a light source, a beam splitter, e.g. in the form of a sheet of titanium coated glass, a layer of retroreflective material, a clear shelf and a flexible stencil so arranged that, in use, light passes through the stencil from the light source and is reflected by the beam splitter, e.g. titanium coated glass, onto the retroreflective screen. The layer of retroreflective material diverts the incident light, e.g. through 180 degrees, so that when a user looks towards the retroreflective material the image appears suspended in space. The stencil is larger than the clear shelf and consequently has an undulant surface which causes the image itself to be undulant and appear in three dimensions. A cranked shaft is attached to the stencil and is rotated by a motor. As the shaft rotates, the undulations in the flexible stencil alter, thereby causing the image to move.

8 Claims, 2 Drawing Sheets

DISPLAY UNIT

FIELD OF THE INVENTION

This invention relates to a display unit.

BACKGROUND OF THE INVENTION

Display units are known which create an image in space. Such display units typically comprise a light source, a beam splitter comprising a sheet of titanium coated glass, a layer of retroreflective material and a stencil so arranged that, in use, light passing through the stencil causes an image of the stencil to be formed in space. WO 83/03019 discloses one such display unit.

Whilst such display units provide an interesting visual effect they do not catch the eye, nor do they hold an observer's attention for more than a few seconds.

SUMMARY OF THE INVENTION

It is an object of the invention to provide an improved display unit which catches the eye of and observer and captivates his attention.

According to the present invention, there is provided a display unit for producing an unsupported image in space, which display unit comprises:

(a) a light source;

(b) a beam splitter;

(c) a layer of retroreflective material;

(d) an undulant stencil disposed between said light source and said beam splitter; and (e) means for disturbing the undulations in said stencil.

Preferably, the display unit includes a shelf for supporting said stencil.

Advantageously, the means for disturbing the undulations in said stencil comprises an electric motor.

Preferably, the stencil comprises a central portion disposed between two borders of flexible plastics material.

Other objects, features and advantages of the present invention will become more fully apparent from the following detailed description of the preferred embodiments, the appended claims and the accompanying drawings.

DETAILED DESCRIPTION OF THE PREFERRED EMBODIMENT

Figure 1:
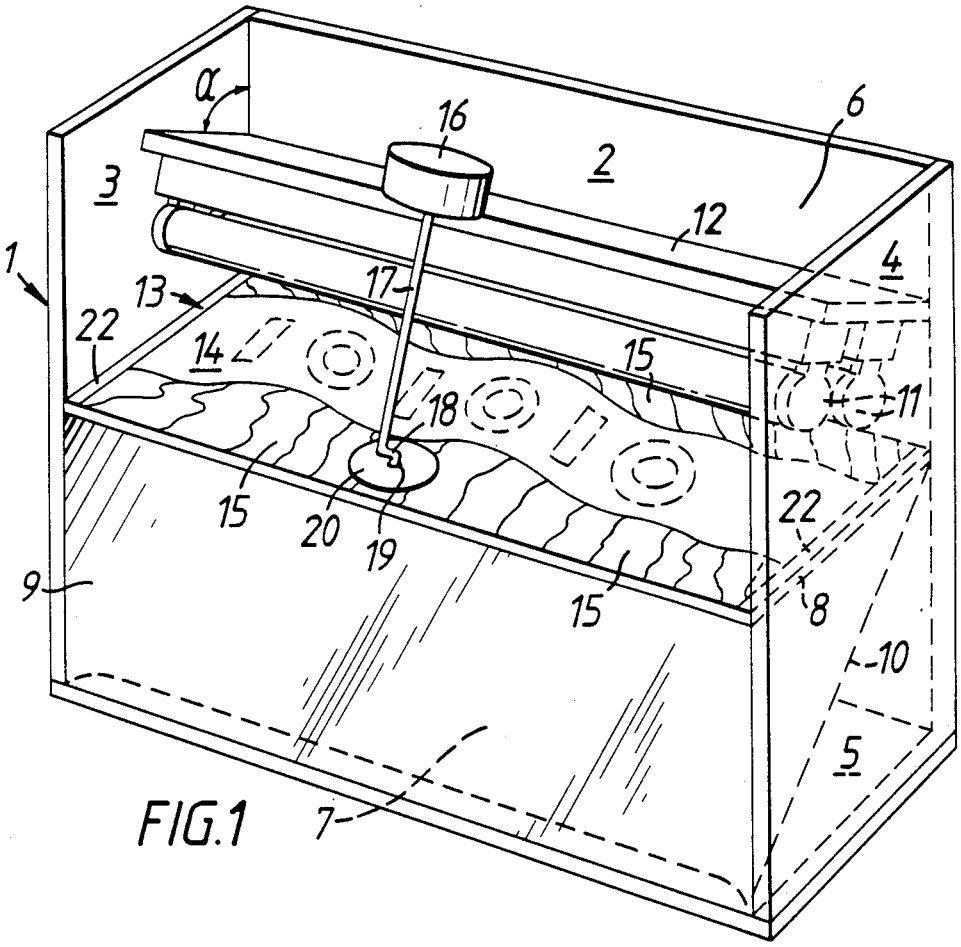
FIG. 1 is a perspective view of a display unit in accordance with the invention with parts removed for clarity.

Referring to FIG. 1, there is shown a display unit which is generally identified by reference numeral 1. The display unit comprises a wooden box having a back 2, two sides 3 and 4, and a bottom 5.

The box is divided into an upper section 6 and a lower section 7 by a transparent clear PERSPEX (RTM) shelf 8.

The front of the lower section 7 comprises a beam splitter formed by a sheet of titanium coated glass 9. The lower section 7 also houses a sheet of retroreflective material 10 which extends from the bottom of the front of the wooden box to the back 2 adjacent the clear PERSPEX (RTM) shelf 8.

The upper section 6 of the display apparatus comprises a pair of 8 watt 30 cm fluorescent tubes 11 which are mounted in tube holder 12 inclined at an angle $\alpha$ of about 25° to the vertical.

A stencil 13 is mounted on the clear PERSPEX (RTM) shelf. The stencil 13 comprises a central portion 14 disposed between two borders 15 of flexible plastics material. The stencil 13 is secured at either end to the clear PERSPEX (RTM) shelf 8 by tape 22. The stencil 13 is however somewhat larger than the clear PERSPEX (RTM) shelf 8 so that instead of laying flat on the clear PERSPEX (RTM) shelf 8 the stencil 13 lies in an undulant manner. The central portion 14 of the stencil 13 comprises a sheet of film bearing the numbers '101010'. The numbers '101010' are transparent whilst the remainder of the central portion 14 and the border 15 are opaque. In the embodiment shown the clear PERSPEX (RTM) shelf 8 is 320 mm×150 mm whilst the stencil is 350 mm×210 mm. The central portion 14 of the stencil is 350 mm×100 mm and is made of polyester film 0.25–12 mm thick whilst the border 15 is made from flexible black polythene strips each 350 mm×55 mm.

Figure 2:
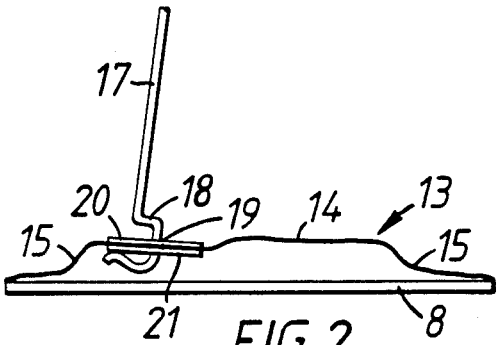
FIG. 2 is a detail of the display unit shown in FIG. 1.

A motor 16 is mounted on the tube holder 12 and is arranged to rotate a shaft 17, and lower end 18 of which is cranked as shown and passes through a hole 19 cut in the border 15 of the stencil 13. As shown in FIG. 2, the hole 19 is reinforced by two thin discs 20 and 21 secured fast to the border 15 to either side of the hole 19.

When the motor 16 is actuated the shaft 17 rotates thereby disturbing the undulations in the stencil 13.

In use, the top and the upper half of the front of the box are closed by opaque members (not shown). Fluorescent tubes 11 are illuminated and power is supplied to motor 16 to rotate shaft 17 at typically 20 revolutions per minute.

The light from the fluorescent tubes 11 passes through the letters '101010' and impinges on the titanium coated glass 9. About 50% of the light passes straight through the titanium coated glass 9. However the balance is reflected onto the layer of retroreflective material 10 which is typically material sold by the 3M company under the Registered Trade Mark HIGH-GAIN type 7160. Retroreflective material has the property of deflecting light which impinges upon it through 180°. Accordingly a person looking downwardly towards the layer of retoreflective material 10 will see the figures '101010' apparently floating in space in a shape and configuration corresponding to the figures on the stencil. It will be noted that the image appears in three dimensions.

As the shaft 17 rotates the undulations in the stencil 13 change. At the same time the letters in space undulate giving the appearance of a wave. The figures thus give a most effective eye catching display.

Figure 3:
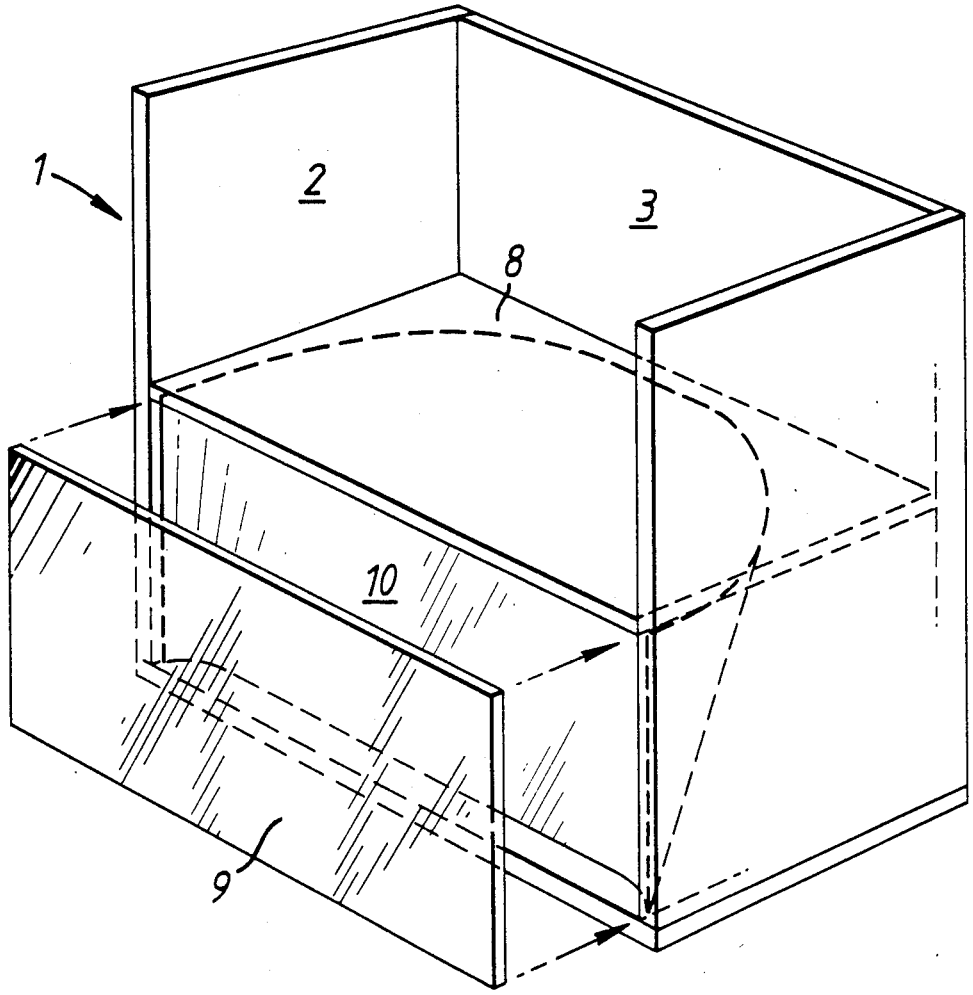
FIG. 3 is an exploded view of part of a modified display unit.

Various modifications to the embodiment described are envisaged, for example the motor 16 may be supplemented by one or more additional motors for undulating other parts of the stencil 13. The stencil 13 may also be fabricated from a single sheet of flexible material. The layer of retroreflective material 10 may be supplemented by retroreflective material on the sides 3 and 4 between the clear PERSPEX (RTM) shelf 8 and the layer of retroreflective material 10. The layer of retroreflective material 10 may be planar (as shown) or may be curved vertically and/or horizontally as shown in FIG. 3.

If desired, the positions of the sheet of titanium coated glass 9 and the layer of retroreflective material can be varied, for example the sheet of titanium coated glass could extend from the bottom rear edge of the box to the front of the glass shelf 8. The retroreflective material could then be placed on the bottom 5 or the back 2 of the lower section 7. In such an embodiment the image would appear substantially vertical.

If desired, the stencil 13 could be made from a single sheet of flexible plastics material, for example polyethylene, appropriately screen printed. The transparent areas of the stencil would preferably be coloured with transparent gels to give an enhanced image.

Although titanium coated glass 9 is preferred as a beam splitter, certain coated plastics material could also be used, for example, PERSPEX (RTM) vacuum coated with a thin layer of titanium.

The above described embodiments, of course, are not to be construed as limiting the breadth of the present invention. Modifications, and other alternative constructions, will be apparent which are within the spirit and scope of the invention as defined in the appended claims.

I claim:

1. A display unit for producing an unsupported image in space, which display unit comprises:

(a) a light source;

(b) a beam splitter;

(c) a layer of retroreflective material;

(d) an undulant, flexible stencil disposed between said light source and said beam splitter; and (e) means for disturbing the undulations in said stencil to give a changing wave like appearance thereto.

2. A display unit as claimed in claim 1, including a shelf for supporting said stencil.

3. A display unit as claimed in claim 1, wherein said means for disturbing the undulations in said stencil comprises an electric motor.

4. A display unit as claimed in claim 1, wherein said stencil comprises a central portion disposed between two borders of flexible plastics material.

5. Unit of claim 1 wherein the stencil is disposed substantially in a horizontal plane.

6. A display unit for producing an unsupported image in space, which display unit comprises:

(a) a light source;

(b) a beam splitter;

(c) a layer of retroreflective material;

(d) a transparent, clear shelf disposed between said light source and said beam splitter;

(e) an undulant, flexible stencil comprising a central portion disposed between two borders of flexible plastics material and secured to said shelf;

(f) an electric motor; and (g) a cranked arm extending from said electric motor and connected to said undulant stencil to disturb physically said undulations in said stencil on actuation of said electric motor to give a changing wave like appearance thereto.

7. Unit of claim 6 wherein the stencil is disposed substantially in a horizontal plane.

8. Display unit for producing an unsupported image in space, comprising a light source, a beam splitter, a layer of retroreflective material, an undulant, flexible plastic stencil disposed substantially in a horizontal plane between the light source and beam splitter, and means for repeatedly disturbing physically the undulations in the stencil, said disturbing means being attached to the stencil for moving the stencil in horizontal direction to give a changing horizontal wave like appearance thereto.

* * * * *